US005126765A

United States Patent [19]

Nakamura

[11] Patent Number: 5,126,765

[45] Date of Patent: Jun. 30, 1992

[54] INK JET RECORDING APPARATUS HAVING CLEANING MEANS FOR CLEANING A RECORDING HEAD

[75] Inventor: Fumiharu Nakamura, Yokohama, Japan

[73] Assignee: Canon Kabushiki Kaisha, Tokyo, Japan

[21] Appl. No.: 514,732

[22] Filed: Apr. 26, 1990

[30] Foreign Application Priority Data

Apr. 26, 1989 [JP] Japan ..... 1-106575

[51] Int. Cl.[5] ..... B41J 2/05

[52] U.S. Cl. ..... 346/140 R; 346/75

[58] Field of Search ..... 346/140 R, 1.1, 75; 400/126

[56] References Cited

U.S. PATENT DOCUMENTS

| | | | |
|---|---|---|---|
| 3,945,020 | 3/1976 | Kraus et al. | 346/75 |
| 4,112,435 | 9/1978 | Kattner et al. | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 344/140 R |
| 4,463,359 | 7/1984 | Ayata et al. | 346/140 R |
| 4,479,134 | 10/1984 | Kawanabe | 346/140 R |
| 4,558,333 | 12/1985 | Sugitani et al. | 346/140 R |
| 4,586,834 | 5/1986 | Hachisuga et al. | 400/120 |
| 4,591,873 | 5/1986 | McCann et al. | 346/75 |
| 4,723,129 | 2/1988 | Endo et al. | 346/1.1 |
| 4,740,796 | 4/1988 | Endo et al. | 346/1.1 |
| 4,745,414 | 5/1988 | Okamura et al. | 346/140 R |
| 4,791,437 | 12/1988 | Accattino et al. | 346/140 R |
| 4,951,066 | 8/1990 | Terasawa et al. | 346/140 R |
| 4,959,673 | 9/1990 | Noda | 346/140 R |
| 5,018,884 | 5/1991 | Hirano et al. | 346/140 R |

FOREIGN PATENT DOCUMENTS

| | | | |
|---|---|---|---|
| 0230135 | 7/1987 | European Pat. Off. . | |
| 54-056847 | 5/1979 | Japan . | |
| 58-094472 | 6/1983 | Japan . | |
| 58-128034 | 8/1983 | Japan . | |
| 59-014964 | 1/1984 | Japan . | |
| 59-123670 | 7/1984 | Japan . | |
| 59-138461 | 8/1984 | Japan . | |
| 60-071260 | 4/1985 | Japan . | |
| 61-230947 | 10/1986 | Japan . | |
| 0097849 | 5/1987 | Japan | 346/140 R |
| 62-101447 | 5/1987 | Japan . | |

OTHER PUBLICATIONS

Abstract of Japan Patent Doc. No. 62-101447 (May 1987).

IBM Technical Disclosure Bulletin, vol. 24, No. 8 (Jan. 1982).

IBM Technical Disclosure Bulletin, vol. 25, No. 3B (Aug. 1982).

Rubber Testing, Nov. 1, 1980.

*Primary Examiner*—Benjamin R. Fuller

*Assistant Examiner*—Victor DeVito

*Attorney, Agent, or Firm*—Fitzpatrick, Cella, Harper & Scinto

[57] ABSTRACT

An ink jet recording apparatus has an ink jet head provided with a discharge port forming surface formed with discharge ports for discharging ink therethrough, a cleaning member for bearing against the discharge port forming surface of the ink jet head to clean the discharge port forming surface, a recording mode setter capable of setting a first recording mode in which the ink is discharged from the ink jet head to effect recording, and a second recording mode differing from the first recording mode, a cleaning mode setter means capable of setting a first cleaning mode corresponding to the first recording mode set by the recording mode setter, and a second cleaning mode corresponding to the second recording mode set by the recording mode setter, and a driver means for moving the ink jet head and the cleaning member relative to each other to effect the cleaning of the discharge port forming surface.

17 Claims, 3 Drawing Sheets

INK JET RECORDING APPARATUS HAVING CLEANING MEANS FOR CLEANING A RECORDING HEAD

BACKGROUND OF THE INVENTION

1. Field of the Invention

This invention relates to an ink jet recording apparatus in which ink is caused to fly by the utilization of pressure, preferably heat energy, to thereby effect recording on a recording medium.

2. Related Background Art

An ink jet recording apparatus is provided with a construction in which ink is supplied to a recording head and energy generating means is driven on the basis of recording information, whereby the ink is discharged from ink discharge ports to thereby form flying ink droplets and the ink droplets are caused to adhere to a recording medium disposed in opposed relationship with the recording head to thereby accomplish recording.

In the recording apparatus of this kind, as shown in FIG. 6 of the accompanying drawings, ink 12 or foreign substances including dust may sometimes adhere to the discharge port forming surface of the recording head including the discharge port portion. In order to remove such ink and foreign substances, there is often provided a cleaning member such as a cleaning blade for cleaning the discharge port forming surface.

Now, as the cleaning member of the prior-art ink jet recording apparatus, there has been proposed one which, as shown, for example, in Japanese Laid-Open Patent Application No. 61-230947, is designed to be put in and out to remove ink adhering to the discharge port forming surface of the recording head after the use of a recovery pump, or one, which, as shown in Japanese Laid-Open Utility Model Application No. 58-128034, is designed to contact with a recording head returned to a home position set in a non-recording area, always with a predetermined amount of contact, a predetermined thickness, predetermined dimensions and a predetermined number of cleaning blades.

Also, as shown in Japanese Laid-Open Patent Application No. 58-94472, there has been proposed one in which a blade is disposed within the deceleration section of a carriage when a recording head carried on the carriage is returned to the non-recording area side, and cleaning is effected in the decelerated condition of the carriage.

Further, as shown in Japanese Laid-Open Patent Application No. 59-14964, there has been proposed one in which a cleaning blade provided on an endless belt disposed in opposed relationship with the discharge port forming surface of a recording head is rotated from up to down to thereby effect cleaning.

In these examples of the prior art, however, the possible cleaning condition for the discharge port forming surface of the recording head is always made simply constant irrespective of the recording condition or irrespective of the difference in recording mode and therefore, there have been cases where the cleaning condition is good in the early stage of cleaning, but when the recording condition or the recording mode changes, sufficient cleaning cannot be accomplished depending on the recording mode, that is, unsatisfactory cleaning begins to take place intermittently and finally, after a long-time use, unsatisfactory cleaning takes place in every recording mode.

Accordingly, the stable obtainment of a long-period cleaning effect has heretofore not been achieved sufficiently.

In view of the above-noted problem, we have made one study after another and have made the following matter clear.

Usually in cleaning, one kind of cleaning condition is set. In this case, the set condition for cleaning is suited for particular one of a plurality of recording modes and therefore, a good result has been obtained in the process wherein this particular recording mode is continued.

In the other recording mode, however, unsatisfactory cleaning has gradually begun to take place and when the other recording mode and said particular mode have been repetitively carried out, unsatisfactory cleaning has gradually begun to take place even in the particular mode wherein good cleaning was seen at the beginning, and the result has been a case where in the two modes, there takes place unsatisfactory cleaning as shown in FIG. 4 of the accompanying drawings.

Further examinations on the basis of the above findings revealing the following:

i) When the recording mode is changed, for example, the scanning speed of a carriage carrying a recording head thereon is changed as in the so-called NLQ (near letter quality) recording wherein recording is effected at a low speed to thereby obtain records of high quality and the so-called draft recording wherein recording is effected at a high speed, the state of contact of the cleaning member with the discharge port forming surface of the recording head differs and gives rise to various influences. That is, the cleaning member mounted on the apparatus side is installed in a predetermined condition and therefore, when the speed of movement of the carriage is high as in the draft recording, the shock during the contact of the cleaning member with the discharge port forming surface is strong and the influence of the contact may result in the retraction of the meniscus position formed in the discharge ports, which in turn may result in unsatisfactory discharge attributable to the entry of bubbles and the retraction of the meniscus.

Or when the speed of movement of the carriage is low as during the NLQ recording, the state of contact of the cleaning member with the discharge port forming surface becomes weak and ink or foreign substances adhering to the discharge port forming surface cannot be sufficiently removed and a pool of ink may be created by incomplete wiping, and this may cause unsatisfactory discharge. That is, where a predetermined cleaning condition is set, the apparent state of contact of the cleaning member with the discharge port forming surface (the cleaning condition) differs by the recording speed condition being changed.

That is, it is preferable in effecting good cleaning of the discharge port forming surface to adopt a construction in which as the speed of the carriage becomes higher as in the aforedescribed draft recording, the amount of contact of the wiper with the discharge port forming surface is made smaller and as the speed of the carriage becomes lower as in the aforedescribed NLQ recording, the amount of contact of the wiper with the discharge port forming surface is made greater to thereby make the apparent state of contact constant.

ii) The amount of ink adhering to the discharge port forming surface is varied by a variation in the recording density, i.e., a variation in the number of discharge ports which discharge the recording liquid per unit time, whereby the state of contact of the cleaning member with the discharge port forming surface of the recording head becomes different and this gives rise to various influences.

That is, the cleaning member mounted on the apparatus side is installed in a predetermined condition as previously described and therefore, for example, when high density recording is effected, the amount of ink adhering to the discharge port forming surface becomes greater. When the cleaning of the discharge port forming surface to which a great amount of ink droplet has adhered is effected by the cleaning member, the contact of the cleaning member with the discharge port forming surface cannot be sufficiently be accomplished due to the surface tension of the adhering ink and the amount of adhering ink, and this may sometimes result in the deterioration of the state of contact, and removal of the ink and foreign substances cannot be accomplished sufficiently and a pool of ink is created by incomplete wiping, and this may cause unsatisfactory discharge.

Or when low density recording is effected, not so much ink adheres to the discharge port forming surface and therefore, the shock during the contact of the cleaning member with the discharge port forming surface is strong and this may result in the retraction of the meniscus, which may cause unsatisfactory discharge attributable to the entry of bubbles and the retraction of the meniscus. That is, when a predetermined cleaning condition is set, the apparent state of contact of the cleaning member with the discharge port forming surface (the cleaning condition) becomes different by the recording density condition being changed.

That is, it is preferable in effecting good cleaning of the discharge opening forming surface to adopt a construction in which as the recording density becomes lower, the amount of contact of the cleaning blade with the discharge port forming surface is made smaller and as the recording density becomes higher, the amount of contact of the cleaning blade with the discharge port forming surface is made greater to thereby make the apparent state of contact constant.

SUMMARY OF THE INVENTION

It is an object of the present invention to solve the above-noted problems peculiar to the prior art and to provide an ink jet recording apparatus of high reliability in which even where there is a plurality of recording modes in which the speed of a carriage is varied or the recording density is varied, the state of contact of a cleaning blade with a discharge port forming surface is made constant to thereby accomplish good cleaning and unsatisfactory discharge of ink does not occur after the completion of the cleaning.

Particularly in an ink jet recording apparatus directed to high-speed recording, there has been adopted a cleaning condition similar to that in a case where only when cleaning is effected, the speed of a carriage is reduced (decelerated cleaning) to effect low-speed recording, but to achieve still higher speed recording (to increase the throughput), decelerated cleaning cannot cope therewith.

The present invention makes high-speed recording possible without reducing the throughput and makes good cleaning of the discharge port forming surface of a recording head possible.

It is also an object of the present invention to provide an ink jet recording apparatus having:

an ink jet head provided with a discharge port forming surface formed with discharge ports for discharging ink therethrough;

a cleaning member for bearing against the discharge port forming surface of said ink jet head to clean said discharge port forming surface;

recording mode setting means capable of setting a first recording mode in which the ink is discharged from said ink jet head to effect recording, and a second recording mode differing from said first recording mode;

cleaning mode setting means capable of setting a first cleaning mode corresponding to said first recording mode set by said recording mode setting means, and a second cleaning mode corresponding to said second recording mode set by said recording mode setting means; and driving means for moving said ink jet head and said cleaning member relative to each other to effect the cleaning of said discharge port forming surface.

It is a further object of the present invention to provide an ink jet recording apparatus having:

an ink jet head provided with discharge ports for discharging ink therethrough;

carriage means for moving said ink jet head between a recording position in which recording is effected with said ink jet head opposed to a recording medium and a non-recording position in which said ink jet head is retracted from said recording position;

a cleaning member provided in the movement path between said recording position and said nonrecording position and adapted to bear against a discharge port forming surface in which said discharge ports of said ink jet head are formed and effecting the cleaning of said discharge port forming surface;

recording mode setting means capable of setting a first recording mode in which ink is discharged from said ink jet head to effect recording, and a second recording mode differing from said first recording mode; and cleaning mode setting means capable of setting a first cleaning mode corresponding to said first recording mode set by said recording mode setting means, and a second cleaning mode corresponding to said second recording mode set by said recording mode setting means.

The first recording mode and the second recording mode differing from the first recording mode, herein referred to, are typified by one of the high-speed recording mode, the low speed recording mode, the monochromatic recording mode, the polychromatic recording mode, the high-density recording mode and the low-density recording mode or a complex mode of these.

The aforedescribed high-speed recording mode is called the draft recording, and the low-speed recording mode is directed to recording of high quality and is called NLQ (near letter quality) or LQ.

The recording speed is such that when the speed of the low-speed recording is 1, the speed of the high-speed recording is about double that of the low-speed recording Also, the aforedescribed low-density recording includes alphanumeric characters used in ordinary letter sentences, and refers to the recording in which when for example, a font box for one character is a matrix of 48×36 (length×width) dots, about 20–30% of the matrix is filled up, and the high-density recording refers to the recording in which the threshold value of the low density is exceeded. Particularly in the present invention, it is to be understood that distinction is made between the high-density recording and the low-density recording with the average duty when predetermined continuous recording is effected as the subject, and for example, even a case where there is one character of full matrix pattern in a usually used letter sentence is judged as the low-density recording in accordance with the definition in the aforedescribed example.

Also, the first cleaning condition and the second cleaning condition are relative, and differ by varying the number of cleaning members bearing against the discharge port forming surface to effect cleaning, varying the area of contact by the cleaning member, selectively using cleaning members of different materials, changing the amount of overlap or entry (the relative position) of the cleaning member into the recording head position including the area of passage of the recording head, changing the condition of the cleaning member so that the cleaning action time may become constant even when the speed of movement of the recording head varies, changing the cleaning time itself, relatively changing the cleaning direction (only one of the horizontal direction and the vertical direction, or the forward direction and the backward direction), or relatively changing the angle of installation of the cleaning member disposed relative to the discharge port forming surface, or by a combination of the above.

In the present invention, even when the recording mode is changed, a cleaning condition fit for each recording mode can be appropriately given to properly accomplish the cleaning by the cleaning member and therefore, the deterioration of the quality of recording by unsatisfactory discharge can be broadly prevented, and even immediately after the change to a different recording mode, more stable cleaning can be accomplished by a cleaning condition corresponding to the changed recording mode, whereby stable recording can be maintained.

In the above-described construction, it is preferable that the number, dimensions and material of the cleaning members and the amount of contact of the cleaning members with the recording head be varied by the speed of the carriage.

Also, in the above-described construction, it is preferable that the number, dimensions and material of the cleaning members and the amount of contact of the cleaning members with the recording head be varied by the recording density.

When carrying out the ink jet recording apparatus of the present invention, the cleaning condition such as one of the amount of contact, number, dimensions and material of the cleaning blades optimally given in each recording mode or a combination thereof is controlled on the basis of a signal which has detected a variation in the speed of the carriage or a variation in the recording density, or in conformity with the set recording mode, and for example, where the speed of the carriage is low or the recording density is high when the speed of the carriage or the recording density has varied, the amount of contact (the amount of entry) of the cleaning blade with (into) the discharge port forming surface of the recording head is controlled in the longer direction and where the speed of the carriage is high or the recording density is low, the amount of contact of the cleaning blade is controlled in the shorter direction. Also, the control of the cleaning condition permits various combinations within a range which satisfies the aforedescribed conditions.

Thus, over a predetermined area of the ink discharge port forming surfaces matching each recording mode, a cleaning (wiping) operation which ensures good contact of the blade with the discharge port forming surface and which is moreover high in efficiency can be accomplished.

DESCRIPTION OF THE PREFERRED EMBODIMENTS

The present invention will hereinafter be described specifically with reference to the drawings.

Embodiment 1

Description will first be made of an embodiment in which the amount of contact of a cleaning blade with a recording head is changed.

Figure 1:
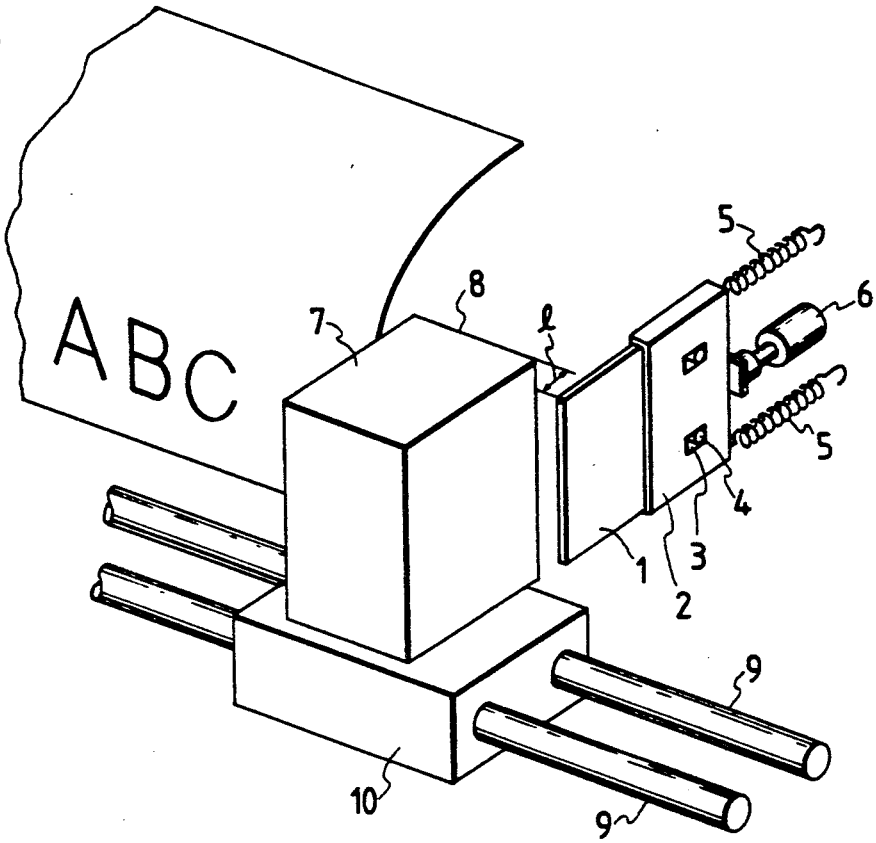
FIG. 1 is a schematic perspective view showing the essential portions of an ink jet recording apparatus according to an embodiment of the present invention.

FIG. 1 is a schematic perspective view showing the essential portions of an ink jet recording apparatus according to an embodiment of the present invention. In FIG. 1, the reference number 1 designates a cleaning blade which is a cleaning member, the reference numeral 2 denotes a cleaning blade supporting member for supporting the cleaning blade 1, the reference numeral 3 designates a contact amount adjusting hole for adjusting the longitudinal position of the cleaning blade 1 and adjusting the amount of contact of the cleaning blade with the discharge port forming surface of a recording head, and the reference numeral 4 denotes a stopper for controlling the retracted position of the cleaning blade 1 relative to the supporting member 2. The stopper 4 is provided, for example, on the side wall of a capping member, not shown, for recovering and holding the recording head. The reference numeral 5 designates springs for biasing the cleaning blade 1 in the backward direction in which the cleaning blade is spaced apart from the recording head, the reference numeral 6 denotes a solenoid for driving the cleaning blade 1 forwardly toward the recording head, the reference numeral 7 designates the recording head, the reference numeral 8 denotes a discharge port forming surface which is in the front of the recording head and in which ink discharge ports are arranged, the reference numeral 9 designates guide shafts installed on the frame member of the recording apparatus, and the reference numeral 10 denotes a carriage carrying the recording head 7 thereon and movable in the direction of recording column along the guide shafts 9. This carriage 10 is scanned by the drive of a drive source, not shown.

Where the recording apparatus has two carriage speeds in conformity with the quality of recording, on the low speed side, the cleaning blade 1 is pushed out by the pushing-out operation of the solenoid 6 and the amount of contact of the cleaning blade 1 with the discharge port forming surface 8 during wiping becomes greater.

On the other hand, when the carriage speed has shifted to the high speed side, the pushing-out operation of the solenoid 6 is released and the cleaning blade 1 is retracted by the spring forces of the springs 5.

That is, the cleaning blade 1 is moved away from the recording head 7 until the stopper 4 thereof strikes against the rear wall of the contact amount adjusting hole 3 in the cleaning blade supporting member 2.

By this retracting movement, the amount of contact of the cleaning blade 1 with the discharge port forming surface 8 becomes smaller when the carriage speed is on the high speed side.

The amount of contact in a case where the carriage speed (the recording speed) has two modes of low speed and high speed differs depending on the carriage speed, but it is preferable that the amount of contact be selected from a range of 0.8–2 mm at the low speed and be selected from a range of 0.15–1.2 mm at the high speed. This amount of contact refers to the amount of overlap between the cleaning blade 1 and the discharge port forming surface of the recording head 7 which is indicated by l in FIG. 1.

Now, in the cleaning of the discharge port forming surface by the cleaning blade, the following conditions are required as premises.

(1) That during the cleaning (during the contact of the cleaning blade with the discharge port forming surface), the edge portion of the cleaning blade contacts the discharge port forming surface.

This is because when the cleaning blade is in contact with the discharge port forming surface and is moved, ink droplets and dust or the like adhering to the discharge port forming surface are scraped off substantially by the edge portion of the cleaning blade. Thus, in a state in which the amount of contact of the cleaning blade is too great and the cleaning blade is bent horizontally during its contact, there is no effect of cleaning, and this may result in a state in which the ink and dust are collected near the discharge ports, which in turn may result in unsatisfactory discharge.

(2) That during cleaning, the cleaning blade does not vibrate or bound on the discharge port forming surface.

If the cleaning blade bounds on the discharge port forming surface, there will not be obtained the effect of uniformly wiping the discharge port forming surface and also, the retraction of the meniscus in the discharge ports will be caused by the shock or the like when the cleaning blade bounds, and bubbles may enter the discharge ports, thus resulting in unsatisfactory discharge.

(3) That the scattering of the ink from the cleaning blade when the cleaning blade separates from the discharge port forming surface immediately after cleaned is minimum.

By cleaning, ink droplets and dust adhering to the cleaning blade side may sometimes be scattered due to the vibration of the blade when the blade separates from the discharge port forming surface. Such scattered ink may sometimes contaminate the interior of the apparatus of the recording medium and therefore, it is preferable that a material having a certain degree of rigidity and yet having flexibility by used as the material of the cleaning blade.

The cleaning blade suitably used in the present embodiment may preferably have a hardness greater than 35° and less than 80° (Japanese Industrial Standard (JIS), which is equivalent to greater than 36° and less than 83° Shore-Durometer A hardness), a thickness greater than 0.2 mm and less than 1.5 mm and a free length ranging from 2 mm to 15 mm, whereby the aforementioned premises required of the cleaning blade can be satisfied.

Embodiment 2

When the recording density is on the low density side, the cleaning blade 1 is moved in the same direction as that when the carriage speed is on the high speed side, i.e., the direction in which the amount of contact of the cleaning blade with the discharge port forming surface 8 becomes smaller, and when the recording density is on the high density side, the cleaning blade 1 is moved in the same direction as that when the carriage speed is on the low speed side i.e., the direction in which the amount of contact of the cleaning blade with the discharge port forming surface 8 becomes greater.

Figure 5:
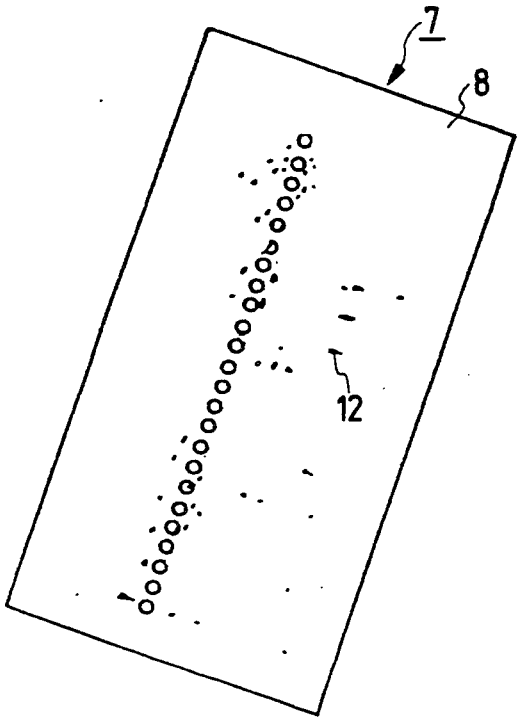
FIG. 5 is a schematic view showing a well cleaned discharge port forming surface.
Figure 6:
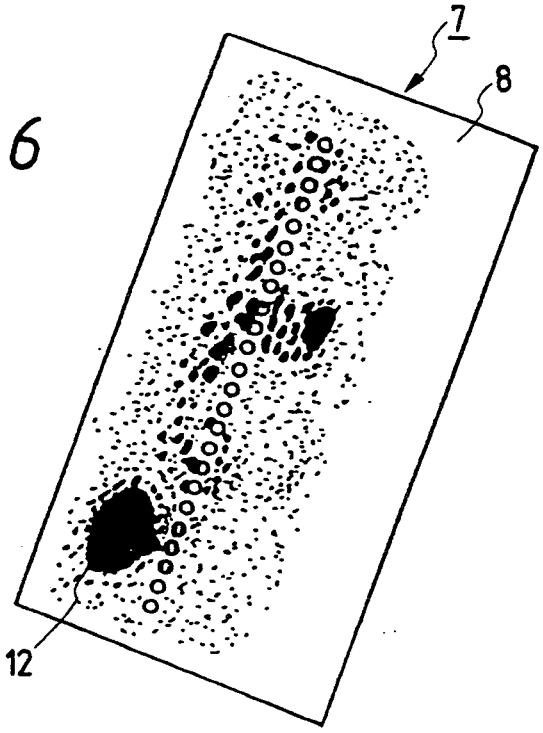
FIG. 6 is a schematic view showing a discharge port forming surface to which ink and dust adhere.

According to Embodiments 1 and 2 described above, the cleaning blade 1 which is a cleaning member for removing (wiping off) ink or foreign substances adhering to the discharge port forming surface 8 of the recording head 7 is movable back and forth and the longitudinal position thereof is adjusted in conformity with a variation in the carriage speed or the recording density, whereby the amount of contact of the cleaning blade 1 with the discharge port forming surface 8 of the recording head 7 may be adjusted and therefore, there is provided an ink jet recording apparatus in which even if the carriage speed or the recording density varies as shown in FIG. 5, no ink or dust remains on the discharge port forming surface after cleaning and the occurrence of unsatisfactory discharge can be prevented and moreover a high cleaning performance can be secured for a long period of time without being affected by the recording condition.

Embodiment 3

Description will now be made of an embodiment which uses a plurality of kinds of cleaning blades differing in condition from each other.

Figure 2:
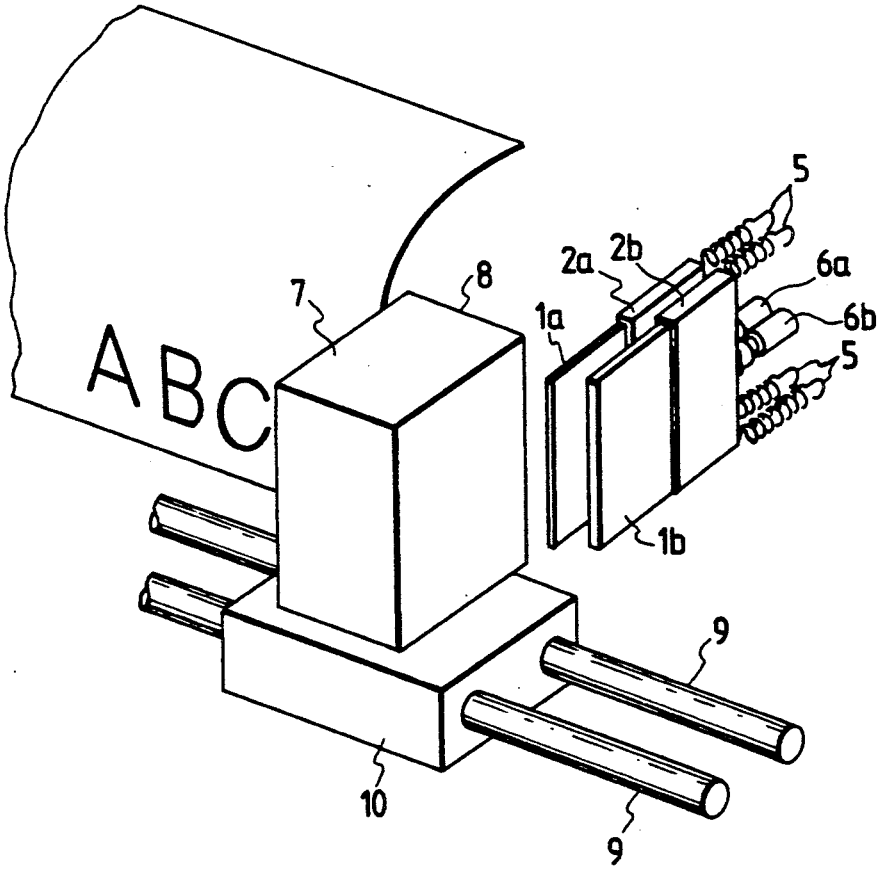
FIG. 2 is a schematic perspective view showing the essential portions of an ink jet recording apparatus according to another embodiment of the present invention.

FIG. 2 is a schematic perspective view showing the essential portions of an ink jet recording apparatus according to another embodiment of the present invention.

In the present embodiment, use is made of a plurality of (in the shown embodiment, two) cleaning blades **1*a* and 1*b* differing from each other in the amount of contact with the discharge port forming surface 8 of the recording head 7** and the blade thickness.

The cleaning blades **1*a* and 1*b* are supported for movement back and forth by respective support members 2*a* and 2*b*, and are designed to have their longitudinal positions independently controlled by individual solenoids 6*a* and 6*b***.

Accordingly, the plurality of cleaning blades **1*a* and 1*b*** differing in the amount of contact during cleaning and differing in blade thickness can be selectively put in and out in conformity with a variation in the carriage speed or the recording density.

Control is effected so that for example, when the carriage speed is on the high speed side or when the recording density is on the low density side, use is made of the cleaning blade 1b having a great blade thickness, e.g. greater than 0.5 mm and less than 1.5 mm and having a small amount of contact, and that when the carriage speed is on the low speed side or when the recording density is on the high density side, use is made of the cleaning blade 1a having a small blade thickness, e.g. greater than 0.2 mm and less than 0.8 mm and having a great amount of contact.

The embodiment of FIG. 2 differs in the above-described point from the embodiment of FIG. 1, but is of the same construction in the other points, and corresponding portions thereof are designated by identical reference numerals and need not be described in detail.

Again by the embodiment of FIG. 2, the amounts of contact of the cleaning blades 1a and 1b with the discharge port forming surface of the recording head 7 and the blade thicknesses can be adjusted in conformity with any variation in the carriage speed or the recording density and accordingly, as in the aforedescribed case, no ink and dust remains on the discharge port forming surface as shown in FIG. 5 after the cleaning operation (the wiping-off) by the cleaning blades 1a and 1b and unsatisfactory discharge can be eliminated.

Embodiment 4

Description will now be made of an embodiment which uses cleaning blades formed of two different materials.

For example, a silicone material of high hardness relatively lacks tackiness and has good sharpness when it is worked into a blade, and permits the edge of the blade to be suitably formed. Accordingly, this material exhibits a good cleaning effect even for high-speed carriage movement by high-speed recording or for high-density recording.

Also, nitrile butadiene rubber of low hardness containing hydrogen therein is relatively flexible and tacky, but permits the edge of the blade to be formed well when it is worked into a blade. Accordingly, this material exhibits a good cleaning effect for low-speed carriage movement by low-speed recording or for low-density recording without injuring the discharge port forming surface.

When actually the apparatus construction as shown in FIG. 2 was utilized and silicone having a hardness of 50° (JIS), which is equivalent to 52° Shore-Dorometer A hardness, an amount of entry 0.5 mm and a free length of 0.8 mm was used as a high-speed blade and nitrile or butadiene rubber containing hydrogen hydrogenated nitrile butadiene rubber and having a hardness of 35° (JIS), which is equivalent to hardness, 36° Shore-Durometer A, an amount of entry 1.0 mm and a free length of 0.5 mm was used as a low-speed blade, there could be obtained a very good cleaning effect as shown in FIG. 5 under each recording condition.

Embodiment 5

Description will further be made of an embodiment in which the angle of mounting of the cleaning blade relative to the recording head is changed to thereby change the amount of contact and the manner in which the edge of eh blade is positioned.

Figure 3:
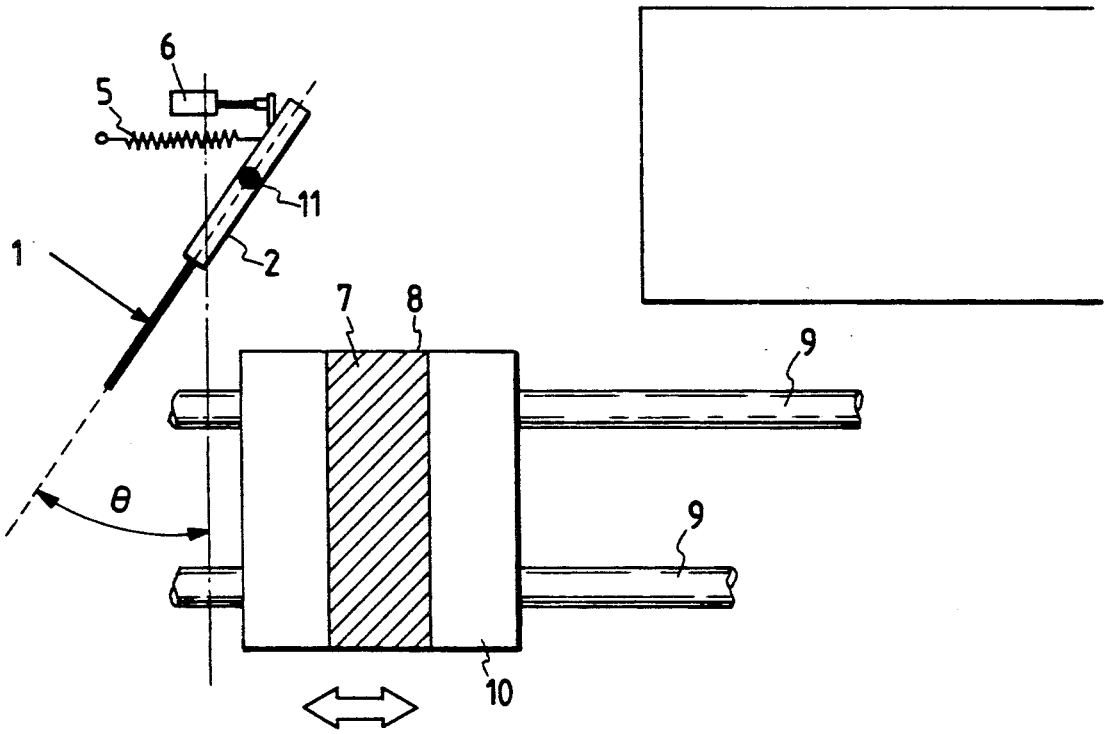
FIG. 3 is a schematic perspective view showing the essential portions of an ink jet recording apparatus according to still another embodiment of the present invention.
Figure 4:
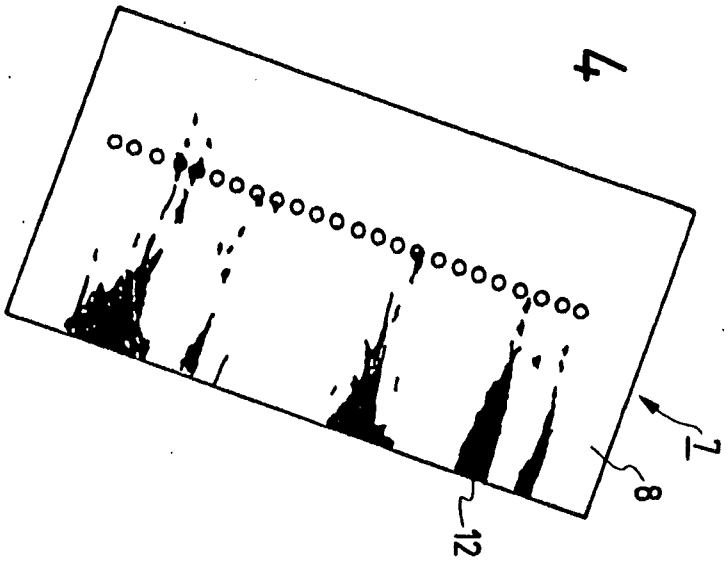
FIG. 4 is a schematic view showing the state of unsatisfactory cleaning of a discharge port forming surface.

The present embodiment, as shown in FIG. 3, is of a construction in which the angle of contact of the cleaning blade 1 with the recording head 7 is adjusted about a rotary shaft 11 provided in the central portion of the blade supporting member 2, by driving a solenoid 6.

In this construction, when low-speed recording or high-density recording is effected, the solenoid is driven so that the blade 1 may bear against the recording head at an angle approximate as much as possible to a right angle, e.g. $\theta=0°-30°$, thereby enhancing the contact pressure. On the other hand, when high-speed recording or low-density recording is effected, the blade 1 is set to an angle side on which it lies down, and the contact pressure is reduced, e.g. to $\theta=25°-45°$, thereby adjusting the contact condition.

By doing so, the contact pressure can be made optimum one conforming to the recording conditions, and the cleaning effect is improved as shown in FIG. 5.

These angles are not limited to this range, but may suitably be selected within a range for which the cleaning characteristic is improved, particularly a range of $\theta=0°-45°$.

In the above-described embodiments description has been made with respect to a case where the amount of contact of the cleaning member with the discharge port forming surface 8 of the recording head 7 and the blade thickness are varied in conformity with any variation in the carriage speed or the recording density, or a case where blades of different materials are used or the angle of contact of the blade with the discharge port forming surface is varied, but when carrying out the present invention, the dimensions and materials of the cleaning members 1 may be made variable and adjusted, such as using the same kind of rubber for the cleaning members and changing the hardness of the rubber, and changing the degree of surfaces smoothness of the cleaning members, whereby a similar effect can also be achieved.

The present invention brings about an excellent effect particularly in a recording head and recording apparatus of the bubble jet type, among the ink jet recording systems.

As regards the typical construction and principle thereof, a system using the basic principle disclosed, for example, in U.S. Pat No. 4,723,129 or U.S. Pat. No. 4,740,796 is preferable. This system is applicable to both of the so-called on-demand type and the so-called continuous type, and particularly in the case of the on-demand type, it is effective because at least one driving signal corresponding to recording information and providing a rapid temperature rise exceeding nuclear boiling is applied to an electro-thermal converting member disposed correspondingly to a sheet or a liquid path retaining ink therein, thereby generating heat energy in the electro-thermal converting member, and film boiling is caused to occur in the heat-acting surface of a recording head with a result that a bubble in liquid (ink) corresponding at one to one to said driving signal can be formed. By the growth and contraction of this bubble, the liquid (ink) is discharged through a discharge opening to thereby form at least one droplet. If said driving signal is made into the form of a pulse, the growth and contraction of the bubble take place appropriately on the spot and therefore, discharge of the liquid (ink) which is particularly excellent in responsiveness can be accomplished, and this is more preferable. The signal as described in U.S. Pat. No. 4,463,359 and U.S. Pat. No. 4,345,262 is suitable as this pulse-shaped driving signal. If the conditions described in U.S. Pat. No. 4,313,124 which discloses an invention relating to the temperature rise rate of said heat-acting surface are adopted, more excellent recording can be accomplished.

As the construction of the recording head, besides a construction comprising a combination of a discharge port, a liquid path and an electro-thermal converting member as disclosed in each of the above-mentioned patents (a rectilinear liquid flow path or a perpendicular liquid flow path), a construction using U.S. Pat. No. 4,558,333 or U.S. Pat. No. 4,459,600 which discloses a construction in which a heat-acting portion is disposed in a bent area is also covered by the present invention. In addition, the present invention is also effective if it adopts a construction based on Japanese Laid-Open Patent Application No. 59-123670 which discloses a construction in which a slit common to a plurality of electrothermal converting members is used as the discharge portion of the electro-thermal converting members or Japanese Laid-Open Patent Application No. 59-138461 which discloses a construction in which an opening for absorbing the pressure wave of heat energy corresponds to the discharge portion.

Further, as a recording head of the full line type having a length corresponding to the width of the largest recording medium on which the recording apparatus can effect recording, use may be made of any of a construction which satisfies that length by a combination of a plurality of recording heads as disclosed in the above-mentioned publications and a construction as a single recording head formed as a unit, and the present invention can display the above-described effect more effectively.

In addition, the present invention is also effective in a case where use is made of a recording head of the interchangeable chip type which permits the electrical connection to the apparatus body and the supply of ink from the apparatus body by being mounted on the apparatus body, or a recording head of the cartridge type integrally provided on the recording head itself.

Also, the addition of recovery means, preliminary auxiliary means, etc. for the recording head which are provided in the construction of the recording apparatus of the present invention can more stabilize the effect of the present invention and therefore, this is preferable. Specifically, they include capping means and pressing or suction means for the recording head, and preheating means comprising an electro-thermal converting member or a heating element discrete therefrom or a combination of these, and it is also effective for accomplishing stable recording to carry out the preliminary discharge mode in which discharge discrete from recording is effected.

Further, as regards the recording modes of the recording apparatus, use may be made not only of the recording mode of only the main color such as black, but also of a recording head constructed as a unit or comprising a combination of a plurality of heads, and the present invention is also very effective for an apparatus provided with at least one of a complex color comprising different colors and full color comprising a mixture of colors.

In the above-described embodiments of the present invention, ink has been described as liquid, but use may be made of any ink which solidifies at room temperature or below and softens or liquifies at room temperature, or any ink which assumes its liquid phase when a recording signal is imparted thereto, because in the above-described ink jet, it is popular to control the temperature so that ink itself is temperature-regulated within a range of 30° C. to 70° C. and the viscosity of the ink is within a stable discharge range. In addition, the temperature rise by heat energy is positively used as the energy for the phase change of ink from its solid state to its liquid state to thereby prevent the solidification of the ink, or use is made of ink which solidified when it is left for the purpose of preventing the evaporation of the ink, and in any case, the use of ink of such a nature that it is liquefied only by heat energy, such as ink which is liquefied by heat energy being imparted thereto in conformity with a recording signal and is discharged in the form of ink liquid or ink which begins to solidify at point of time whereat it arrives at the recording medium is also applicable to the present invention. The present invention is also effectively used for the cleaning when such ink adheres to the discharge port forming surface and is thereby solidified. In such a case, the ink may be in a form as described in Japanese Laid-Open Patent Application No. 54-56847 or Japanese Laid-Open Patent Application No. 60-71260 wherein the ink is opposed to an electro-thermal converting member while being retained as a liquid or a solid in the recesses of a porous sheet or a through-hole. In the present invention, what is most effective for the above-described inks is one which executes the above-described film boiling system.

As is apparent from the foregoing description, in an ink jet recording apparatus having cleaning members for contacting with the discharge port forming surface of a recording head to thereby remove ink or foreign substances adhering to said discharge port forming surface, the number, dimensions and materials of the cleaning members and the amount of contact of the cleaning members with the recording head are made variable and these conditions can be varied in conformity with any variation in the carriage speed or the recording density and therefore, the cleaning condition can be made constant in conformity with the recording condition and the wiping of the discharge port forming surface of the recording head by the cleaning member can be accomplished effectively, and thus, cleaning characteristic for a long period of time is improved and it has become possible to effect good recording without the occurrence of unsatisfactory discharge.

As is apparent from the foregoing description, according to the present invention, the problem which has arisen when the same cleaning condition is adopted even for a change in a plurality of recording modes as in the prior art can be solved, and the cleaning condition suitable for each recording mode can be provided and therefore, the cleaning condition in that recording mode itself can be adjusted optimally and thus, the occurrence of unsatisfactory discharge can be broadly prevented, and even immediately after the change to a different recording mode, more stable recording can be maintained by a cleaning condition suitable for the changed recording mode while the cleaning load in the changed recording mode is reduced.

Particularly, the present invention when effecting high-speed recording, can set a cleaning condition suitable for high-speed recording and therefore, can accomplish good cleaning without reducing, as in the prior art, the throughput, which is reduced when decelerated cleaning is effected.

I claim:

1. An ink jet recording apparatus having:

an ink jet head provided with a discharge port forming surface formed with discharge ports for discharging ink therethrough, said ink jet head being movable between a recording area and a non-recording area;

a cleaning member for bearing against the discharge port forming surface of said ink jet head to clean said discharge port forming surface, said cleaning member being shiftable between a cleaning position for contacting said head at the non-recording area and a non-cleaning position remote from said head;

recording mode setting means capable of setting a first recording mode in which the ink is discharged form said ink jet head to effect recording, and a second recording mode differing form said first recording mode;

cleaning mode setting means capable of setting a first cleaning mode corresponding to said first recording mode set by said recording mode setting means, and a second cleaning mode corresponding to said second recording mode set by said recording mode setting means; and driving means for moving said ink jet head and said cleaning member relative to each other to effect wiping of said discharge port forming surface.

2. An ink jet recording apparatus according to claim 1, wherein said first recording mode and said second recording mode each include one mode selected form at least one of the following paris of modes:

a high-speed recording mode and a low-speed recording mode, a single-color mode and a plural-color mode, and a high-density recording mode and a low-density recording mode.

3. An ink jet recording apparatus according to claim 1, wherein said first cleaning mode and said second cleaning mode differ in at least one of the following cleaning conditions: a number of times of contact of said cleaning member bearing against and cleaning said discharge port forming surface, an area of contact of said cleaning member against said discharge port forming surface, a material comprising said cleaning member, an amount of overlap between said discharge port forming surface and said cleaning member, a cleaning time, a cleaning time in one cleaning step, and a direction of movement and cleaning of said cleaning member relative to said discharge port forming surface.

4. An ink jet recording apparatus according to claim 1, wherein said cleaning member is disposed so that in both of said first cleaning mode and said second cleaning mode, an area of said cleaning member including an end edge portion thereof may bear against said discharge port forming surface of said ink jet had, and the area of said cleaning member including the end edge portion thereof moves on and relative to said discharge port forming surface while keeping contact with said surface, whereby cleaning is accomplished.

5. An ink jet recording apparatus according to claim 1, wherein in said first and second cleaning modes, a hardness of said cleaning member is greater than 35° and less than 80° (JIS), and in both of said cleaning modes, an area of said cleaning member including an end edge portion thereof moves on and relative to said discharge port forming surface while keeping contact with said surface, whereby cleaning is accomplished.

6. An ink jet recording apparatus according to claim 1, wherein in said first and second cleaning modes, said cleaning member has a thickness greater than 0.2 mm and less than 1.5 mm, and in both of said cleaning modes, an area of said cleaning member including an end edge portion thereof moves on and relative to said discharge port forming surface while keeping contact with said surface, whereby cleaning is accomplished.

7. An ink jet recording apparatus according to claim 1, wherein in said first and second cleaning modes, said cleaning member has a free length greater than 2 mm and less than 15 mm, and in both of said cleaning modes, an area of said cleaning member including an end edge portion thereof moves on and relative to said discharge port forming surface while keeping contact with said surface, whereby cleaning is accomplished.

8. An ink jet recording apparatus according to claim 1, wherein in said first and second cleaning modes, an amount of overlap between said cleaning member and said discharge port forming surface of said ink jet head is at least 0.5 mm and less than 2 mm, and in both of said cleaning modes, an area of said cleaning member including an end edge portion thereof moves on and relative to said discharge port forming surface while keeping contact with said surface, whereby cleaning is accomplished.

9. An ink jet recording apparatus according to claim 1, wherein said ink jet head discharges the ink by utilization of heat energy, and includes an electro-thermal converting member as means for generating the heat energy.

10. An ink jet recording apparatus having:

an ink jet head provided with discharge ports on a discharge port forming surface for discharging ink therethrough;

carriage means for moving said ink jet head in a movement path between a recording position in which said ink jet head is opposed to a recording medium to effect recording and a non-recording position in which said ink jet head is retracted from the recording position;

a cleaning member provided in the movement path between said recording position and said non-recording position and adapted to bear against said discharge port forming surface in which said discharge ports of said ink jet head are formed, to thereby wipe said discharge port forming surface;

recording mode setting means capable of setting a first recording mode in which the ink is discharged from said ink jet head to effect recording, and a second recording mode differing from said first recording mode; and cleaning mode setting means capable of setting a first cleaning mode corresponding to said first recording mode set by said recording mode setting means, and a second cleaning mode corresponding to said second recording mode set by said recording mode setting means.

11. An ink jet recording apparatus according to claim 10, wherein said first recording mode and said second recording mode each include one mode from at least one of the following pairs of modes: a high-speed recording mode and a low-speed recording mode, a single-color mode and a plural-color mode, and a high-density recording mode and a low-density recording mode; and wherein said first cleaning mode and said second cleaning mode are set correspondingly to said first recording mode and said second recording mode, respectively, and differ in at least one of the following cleaning conditions: a number of times of contact of said cleaning member bearing against and cleaning said discharge port forming surface, an area of contact of said cleaning member against said discharge port forming surface, a material comprising said cleaning member, an amount of overlap between said discharge port forming surface and said cleaning member, a cleaning time, a cleaning time in one cleaning step, and a direction of movement and cleaning of said cleaning member relative to said discharge port forming surface.

12. An ink jet recording apparatus according to claim 10, wherein said cleaning member is disposed so that in both of said first cleaning mode and said second cleaning mode, an area of said cleaning member including an end edge portion thereof may bear against said discharge port forming surface of said ink jet head, and the area of said cleaning member including the end edge portion thereof moves on and relative to said discharge port forming surface while keeping contact with said surface, whereby cleaning is accomplished.

13. An ink jet recording apparatus according to claim 10, wherein in said first and second cleaning modes, a hardness of said cleaning member is greater than 35° and less than 80° (JIS), and in both of said cleaning modes, an area of said cleaning member including an end edge portion thereof moves on and relative to said discharge port forming surface while keeping contact with said surface, whereby cleaning is accomplished.

14. An ink jet recording apparatus according to claim 10, wherein in said first and second cleaning modes, said cleaning member has a thickness greater than 0.2 mm and less than 1.5 mm, and in both of said cleaning modes, an area of said cleaning member including an end edge portion thereof moves on and relative to said discharge port forming surface while keeping contact with said surface, whereby cleaning is accomplished.

15. An ink jet recording apparatus according to claim 10, wherein in said first and second cleaning modes, said cleaning member has a free length greater than 2 mm and less than 15 mm, and in both of said cleaning modes, an area of said cleaning member including an end edge portion thereof moves on and relative to said discharge port forming surface while keeping contact with said surface, whereby cleaning is accomplished.

16. An ink jet recording apparatus according to claim 10, wherein in said first and second cleaning modes, an amount of overlap between said cleaning member and said discharge port forming surface of said ink jet head is at least 0.5 mm and less than 2 mm, and in both of said cleaning modes, an area of said cleaning member including an end edge portion thereof moves on and relative to said discharge port forming surface while keeping contact with said surface whereby cleaning is accomplished.

17. An ink jet recording apparatus according to claim 10, wherein said ink jet head discharges the ink by utilization of heat energy, and includes an electro-thermal converting member as means for generating the heat energy.

* * * * *

UNITED STATES PATENT AND TRADEMARK OFFICE

CERTIFICATE OF CORRECTION

PATENT NO. : 5,126,765

DATED : June 30, 1992

INVENTOR(S) : FUMIHARU NAKAMURA

It is certified that error appears in the above-identified patent and that said Letters Patent is hereby corrected as shown below:

On the Title page, item [54] TITLE

"MEANS" should read --DEVICES--.

item [30] FOREIGN APPLICATION PRIORITY DATA

Insert: --Apr. 18, 1990 [JP] Japan ..... 2-102418--.

COLUMN 1

Line 3, "MEANS" should read --DEVICES--.

COLUMN 2

Line 23, "on" should read --have been carried out on--.

COLUMN 3

Line 13, "droplet" should be deleted.
Line 16, "be" (second occurrence) should be deleted.

COLUMN 4

Line 66, "recording" should read --recording.--.

COLUMN 7

Line 30, "0.15-1.2" should read --0.5-1.2--.
Line 64, "cleaned" should read --cleaning--.

UNITED STATES PATENT AND TRADEMARK OFFICE

CERTIFICATE OF CORRECTION

PATENT NO. : 5,126,765

DATED : June 30, 1992

INVENTOR(S) : FUMIHARU NAKAMURA

It is certified that error appears in the above-identified patent and that said Letters Patent is hereby corrected as shown below:

COLUMN 8

Line 5, "by" should read --be--.

COLUMN 9

Line 52, "Dorometer" should read --Durometer--.
Line 57, "hardness," should be deleted.
Line 68, "eh" should read --the--.

COLUMN 11

Line 43, "more" should read --further--.

COLUMN 12

Line 7, "solidified" should read --solidifies--.

COLUMN 13

Line 14, "form" should read --from--.
Line 15, "form" should read --from--.
Line 28, "form" should read --from--.
Line 29, "paris" should read --pairs--.
Line 52, "had," should read --head,--.

UNITED STATES PATENT AND TRADEMARK OFFICE

CERTIFICATE OF CORRECTION

PATENT NO. : 5,126,765

DATED : June 30, 1992

INVENTOR(S) : FUMIHARU NAKAMURA

It is certified that error appears in the above-identified patent and that said Letters Patent is hereby corrected as shown below:

COLUMN 16

Line 22, "surface" should read --surface,--.

Signed and Sealed this

Nineteenth Day of October, 1993

Bruce Lehman

*Attest:*

BRUCE LEHMAN

*Attesting Officer*

*Commissioner of Patents and Trademarks*